United States Patent [19]

Brand

[11] 4,440,363

[45] Apr. 3, 1984

[54] LANDING MAT OR THE LIKE

[75] Inventor: Werner Brand, Hagen, Fed. Rep. of Germany

[73] Assignee: Estel Hoesch Werke AG, Dortmund, Fed. Rep. of Germany

[21] Appl. No.: 307,592

[22] Filed: Oct. 1, 1981

[30] Foreign Application Priority Data

Oct. 7, 1980 [DE] Fed. Rep. of Germany ..... 3037809

[51] Int. Cl.[3] ..... B64F 1/00

[52] U.S. Cl. ..... 244/114 R; 404/35; 404/40; 24/573; 52/584; 403/405

[58] Field of Search ..... 244/114 R, 114 B; 404/32, 34, 35, 36, 40, 41, 72, 73; 52/582, 584; 403/405, 406; 24/259 R

[56] References Cited

U.S. PATENT DOCUMENTS

| | | | |
|---|---|---|---|
| 2,294,550 | 9/1942 | Greulich | 404/35 |
| 2,898,741 | 8/1959 | Milliken | 52/584 |
| 3,023,470 | 3/1962 | Patten | 24/259 R |
| 4,062,511 | 12/1977 | Ray | 52/584 |

FOREIGN PATENT DOCUMENTS

| | | | |
|---|---|---|---|
| 244379 | 1/1966 | Austria . | |
| 972537 | 8/1975 | Canada | 24/259 R |
| 1291762 | 4/1969 | Fed. Rep. of Germany . | |
| 1910213 | 3/1973 | Fed. Rep. of Germany . | |
| 2410331 | 9/1974 | Fed. Rep. of Germany . | |
| 2345457 | 4/1975 | Fed. Rep. of Germany | 404/35 |
| 2737179 | 3/1979 | Fed. Rep. of Germany | 404/40 |
| 262845 | 12/1926 | United Kingdom | 404/32 |
| 1048554 | 11/1966 | United Kingdom | 404/35 |

OTHER PUBLICATIONS

European Research Report, Dated Dec. 29, 1981, Listing Above Foreign Documents.

*Primary Examiner*—Trygve M. Blix
*Assistant Examiner*—Ivy M. Shum
*Attorney, Agent, or Firm*—Karl F. Ross; Herbert Dubno

[57] ABSTRACT

A landing mat for compacted terrain is formed by assembling a multiplicity of mat elements in contiguous relationship. Each of these elements has a rectangular plan configuration and is formed along its longitudinal edges with downwardly bent flanges, and between these flanges, with flattened corrugations forming longitudinal ribs perpendicular to the planar upper surface of the element. Stabilizing plates can extend transversely to the ribs and flanges and can have upwardly open slots snugly receiving the ribs. Clips bridging contiguous edges of adjoining elements are fitted into elongated windows spaced inwardly of these edges to hold the elements together and an edge member, likewise having a flattened-corrugation rib, is fixed along one edge of the mat and has downwardly turned tongues fitted into the window of the elements along the latter edge.

4 Claims, 5 Drawing Figures

Fig.1
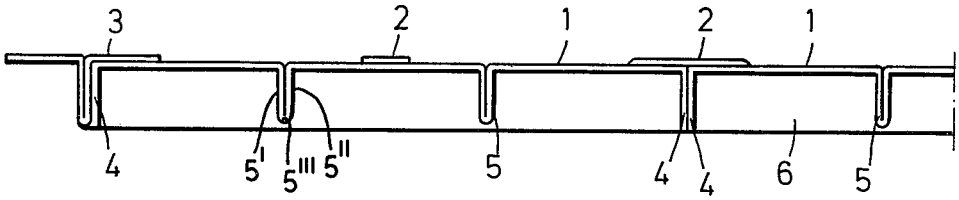
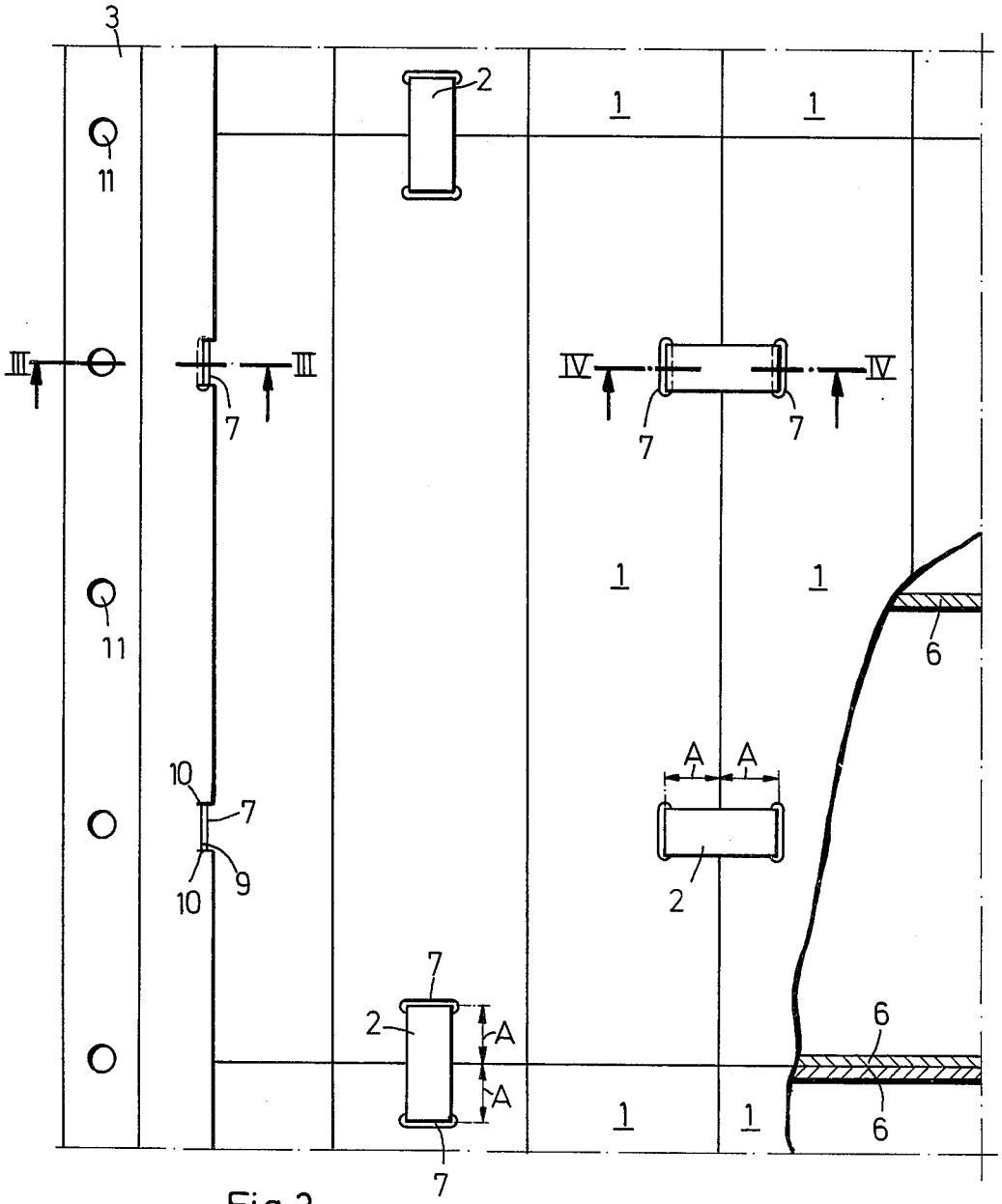
Fig.2

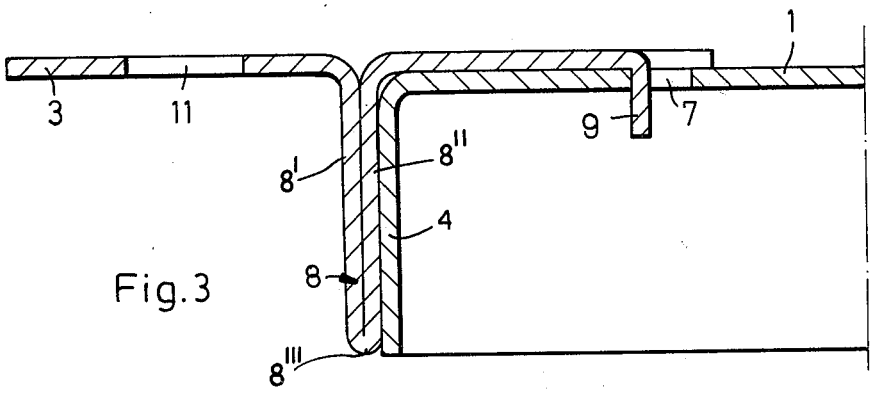
Fig.3
Fig.4
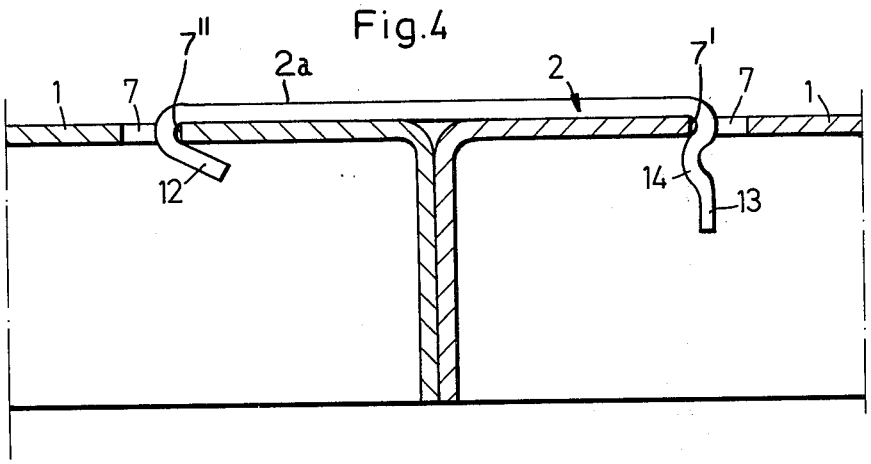
Fig.5
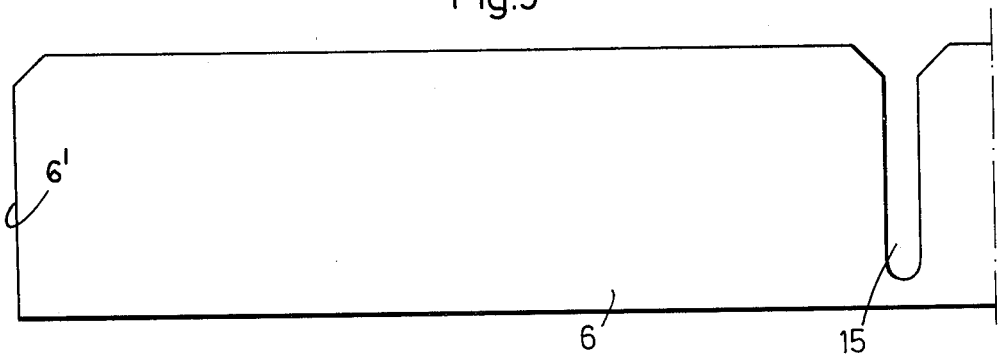

LANDING MAT OR THE LIKE

FIELD OF THE INVENTION

The present invention relates to a stable ground overlay adapted to form a load-carrying surface, e.g. as a roadway or aircraft landing and take-off surface and, more particularly, to a readily assembled landing mat adapted to be placed on precompacted soil.

BACKGROUND OF THE INVENTION

It is frequently desirable to provide relatively easily assembled and disassembled ground overlays of a load-carrying nature to form landing and take-off strips, roadways and surfaces upon which machinery or equipment can be mounted, without the need for fabricating a massive substructure of concrete or like surfaces.

For this purpose, steel overlays formed from a multiplicity of substantially identical elements, can be assembled in the field and, once the need has disappeared, can be disassembled and removed.

Such overlays are primarily used for the landing and take-off of aircraft and are commonly referred to as landing mats. They can be applied over all or a portion of a generally flat strip of terrain, preferably a strip which has been at least somewhat stabilized by precompaction, and the elements of the landing mat can be rectangular units which are joined in contiguous relationship.

As described in German patent document 23 45 457, for example, each unit or element is formed with a plurality of welded ribs or flanges extending parallel to the longitudinal edges of the rectangular element.

Apart from being inordinately expensive, at least in part because of the labor-intensive fabrication technique resulting from the need to weld the ribs or flanges in place, difficulties have been encountered with such elements or units because the forces applied to the landing mat tend to apply stresses to these elements which can break the connection between the platform forming the upper surface of the element and the downwardly extending ribs or flanges welded thereto. However, the ribs and flanges have been found to be essential to prevent buckling or distortion of the upper surface upon which the aircraft may have to land.

OBJECTS OF THE INVENTION

It is the principal object of the present invention to provide a stable ground overlay which can form a load-supporting platform such as a landing and take-off strip, which is free from the disadvantages of earlier systems as described above, can be easily assembled and disassembled, is comparatively inexpensive, and is capable of resisting stresses of a type which have heretofore led to damage of earlier systems.

Another object of the invention is to provide a landing mat which can be easily and inexpensively fabricated but yet is highly stable under all of the conditions encountered in the use of such mats.

SUMMARY OF THE INVENTION

These objects and others which will become apparent hereinafter are attained, in accordance with the present invention, in a load-supporting ground covering which is assembled in substantially coplanar relationship upon precompacted and hence stabilized terrain, from a plurality of multiply contiguous elements or units, each of these elements or units being of generally rectangular plane configuration, constituted of metal and formed with respective downwardly turned flanges at opposite longitudinal edges and, between these flanges, with transversely spaced, mutually parallel ribs formed by flattening corrugations of the unit.

The formation of these ribs can be effected in a single operation since only bending action is involved.

Since the ribs and flanges are formed unitarily with the portion of the unit defining the planar upper surface, there is little tendency for the ribs and flanges to be torn away and the spacing of the ribs and flanges can be uniformly maintained. There is no danger that these elements will break away as may result from an improper welding of separate flanges or ribs to a platform forming the upper surface.

It has also been found to be advantageous to form the underside of each unit with so-called transverse ribs extending at an angle to the longitudinal ribs and flanges, this angle being preferably 90°, although other angles may be used as well.

These transverse ribs can be welded to the longitudinal ribs and flanges and/or to the underside of the platform from which the ribs extend downwardly although it is preferred in this aspect of the invention, to weld them exclusively to the longitudinally extending ribs. In another embodiment of the invention, welding is avoided entirely and the transverse ribs are formed with upwardly open slots adapted to receive the flattened corrugation ribs in a snug or tight manner. Obviously, these slots have the configuration of the cross sections of the flattened ribs.

To facilitate assembly of the mat, units are laid side by side and end to end and are held together by removable clips according to the invention.

Along each edge, the unit can be formed with one or more elongated windows disposed opposite an elongated window of an identical but adjoining unit, the clips bridging the contiguous edges and having members received in these windows.

One end of each clip can be constituted as a hook engaging in the window of one unit while its other end has a downwardly extending arm fitted with a detent bulge so that this arm can be driven into the other window of the pair of interconnect the two units. The elongated windows can have their major dimensions parallel to the respective edges of the units bridged by the clip. The clips can be composed of strip or band steel, can be emplaced by a hook, the first end of each clip over and edge of the respective window and driving the other end of the clip into the window of another unit until it seats below the edge of this window. Neither tools nor extensive mechanical manipulations are required to interconnect the members. The arm of the clip which extends downwardly can be driven into precompacted soil as well so that further stabilization of the mat is ensured and the mat can be maintained under a prestress by the clips so that aircraft landing forces do not cause separation of the units. Because of the simple shape of the clip it can be engaged and seated in place in a particularly simple operation amounting to a single movement by the assembly personnel.

When necessary or desirable, an edge beam can be formed along an edge of the mat and can be connected to a number of units forming this edge. In this case, the edge beam has a flattened corrugation rib and a flange overlying the row of units along the edge of the mat, a downwardly extending tongue from this flange engaging in one of the windows along this edge.

When reference is made herein to the flattened corrugation which form the ribs of the units of each beam, it is intended to thereby describe a rib structure comprising two abutting flat strips of metal bent downwardly from the platform-forming surface and pressed together so that their lower edges are joined by a bight of minimum radius. In practice, such ribs can be formed by forming corrugations in a sheet metal member, e.g. simultaneously with or prior to the bending of the edge flanges therein, and pressing these edges toward one another to reduce the transverse width of the corrugations and eventually clamping each corrugation so that the relatively shallow trough is transformed into a planar interface between two flanks of the troughs which abut one another and lie perpendicular to the platform. The tongue of the edge beam can be formed by stamping from the flange thereof and downward bending.

It will be apparent, therefore, that all of the elements of a landing mat of the invention, i.e. the units, the edge beam and the clips can be formed by simple stamping and bending operations.

The mat structure of the invention can be fabricated at low cost and has a configuration which prevents relative shifting of the units, allowing the units to weigh less than 50 kg each so that they can be assembled by hand to provide an extremely flat and stable flight platform. The static functions are taken up by the terrain, the ribs and flanges penetrating into the precompacted soil.

While the units can be disposed in uniform rows, it is also possible to provide diagonal or like offsetting as in the aforementioned German patent document to increase the load-carrying capacity.

BRIEF DESCRIPTION OF THE DRAWING

The above and other objects, features and advantages of the present invention will become more readily apparent from the following description, reference being made to the accompanying drawing in which:

FIG. 1 is a side-elevational view of a portion of a landing mat in accordance with the present invention;

FIG. 2 is a plan view of this portion of the landing mat;

FIG. 3 is a section taken along the line III—III of FIG. 2 drawn to a larger scale;

FIG. 4 is a section taken along the line IV—IV of FIG. 2, drawn to the same scale as FIG. 3; and FIG. 5 is an elevational view of a transverse platform for use in the reinforcing of the unit of FIGS. 1 through 4, also drawn to the scale of FIG. 3.

SPECIFIC DESCRIPTION

In the drawing there is shown a landing mat or other structure suitable for providing a substantially flat load-supporting surface upon compacted terrain and consisting of rectangular units 1 which are releasably interconnected by clips 2 bridging the contiguous edges of the units. Along the edges of the platform which is thus formed, edge members are provided. The clips have been represented at 2 in the drawing and are best seen in FIG. 4 whereas the edge members 3 which can engage a number of units 1 along one of the edges of the landing mat, are positioned as shown in FIG. 3.

The units 1 are formed along their undersides with downwardly turned flanges 4 extending along the longitudinal (relatively long) edges of the units and, transversely spaced from but parallel to these flanges, with inner ribs 5. As will be apparent from FIG. 1, each inner rib 5 comprises a pair of flanges 5', 5'' parallel to one another and bridged by a bight 5'''. These ribs are formed by pressing tightly against one another the opposite flanks of a corrugation.

The underside of each unit can be provided with transverse ribs as shown at 6 which can lie in planes perpendicular to the ribs 5 and the flanges 4 and can, as seen in FIG. 5, be formed with outwardly open contacts snugly receiving the ribs 5. Members 6 are dimensioned so that their outer edges, e.g. the edge 6', are clamped tightly against the inner cheeks of the flanges 4 so that members 6 can be held in place without welding. Naturally, these flanges can be welded in place if desired. Furthermore, while the members 6 in the preferred construction lie perpendicularly to the members 4 and 5, the members 6 can also include other angles with the flanges and ribs.

At predetermined distances A inwardly from each of the edges of the units 1 both along the short and long sides thereof, elongated windows 7 are provided which have their major axes parallel to the respective edges for engagement with the clips 2 and the edge members 3 (see FIGS. 3 and 4). As will be apparent from FIG. 3, each member 3 is formed as a metal strip with a corrugation which is flattened to form the rib 8. The rib 8 is thus defined between a pair of parallel flanks 8', 8'', interconnected by a bight 8'''. The rib 8 is spaced from a downwardly bent tongue 9 by a distance equal to A−a where a represents half the width of the window 7. Consequently, the flank 8'' is held snugly against the outer of the respective flanges when the tongue 9 is inserted into a respective window 7.

As can be seen from FIG. 2, at least one tongue, and preferably two tongues, engages each unit 1 along the edge of the mat provided with the strip 3.

Each tongue is formed by bending downwardly the region between a pair of parallel cuts 10 stamped into member 3 and running to the edge of the latter.

The side of member 3 turned away from the units 1 is formed with bores 11 which can enable the mat to be moved on the terrain, to be staked in place or to support landing accessories if needed. The tongues 9 and the windows 7 form a releasable connection between members 1 and 3.

As will be evident from FIG. 4, each clip 2, formed from strip steel, is provided at one end with a hook 12 bent at an acute angle to the body **2*a* of the clip, and a tongue 13 bent at right angles to this body and formed with an inwardly bent corrugation 14 of inwardly convex profile. The corrugation is dimensioned to underlie the edge 7' of a window 7 in one unit when the crotch of the hook engages the edge 7'' of a window 7 of an adjoining unit 1**.

To secure two adjoining units 1 together, the hook 12 is engaged in a window 7 of one unit and the tongue 13 is thrust through a corresponding window 7 of the adjoining unit and driven home therein to resiliently lodge the corrugation 14 with the edge 7'.

The body **2*a***, thus lies flat against the upper platform-forming surfaces of the interconnected units.

I claim:

1. A load-supporting platform adapted to rest on precompacted terrain, comprising a multiplicity of multiply adjoining substantially identical units having opposite longitudinal edges continuous with corresponding edges of other units and transverse edges contiguous with corresponding edges of other units, each of said units having a pair of downwardly turned flanges along their opposite longitudinal edges and inner ribs parallel to but spaced from said flanges and formed as flattened corrugations, a transverse rib for at least one of said units extending at an angle to said inner ribs and flanges thereof, each of said units being formed at a predetermined distance inwardly of at least one of its edges with a window opposite a window formed in an adjoining unit along the contiguous edge thereof, and clips spanning contiguous edges of adjoining units and removably received in the windows thereof, said windows being elongated and having a major axis parallel to the respective edge of the unit formed with the window, said clip being a metal strip formed with a hook at one end engageable in one window and, at the other end, with a downwardly turned tongue provided with a corrugation engageable beneath an edge of another of said windows receiving said tongue.

2. The load-supporting platform defined in claim 1 wherein said transverse rib is a plate snugly received between inner cheeks of said flanges of said one of said members and formed with cutouts form-fittingly receiving the inner ribs thereof and corresponding in cross section to said inner ribs of said one of said units.

3. A load-supporting platform defined in claim 1 or claim 2 which is provided with an edge strip along one side of the landing mat, said edge strip having a rib constituted as a flattened corrugation and resting against flanges of said units disposed along said side of said landing mat and with downwardly turned tongues receivable in said windows of the latter units.

4. A landing mat adapted to rest on precompacted terrain comprising:

a multiplicity of substantially identical generally rectangular units having opposite longitudinal edges contiguous with corresponding longitudinal edges of other units and transverse edges contiguous with corresponding transverse edges of other units, each of said units having a pair of downwardly turned flanges along their opposite longitudinal edges, and inner ribs parallel to but spaced transversely from said flanges and formed as flattened corrugations;

at least one transverse rib for at least one of said units constituting a plate having cutouts formed fittingly receiving the inner ribs thereof, the contiguous units being provided parallel to their adjoining edges but spaced inwardly thereof with elongated windows parallel to the respective edges and disposed in pairs of the adjoining units; and respective clips coupling said pairs of windows, each of said clips being formed as a metal strip having a hook at one end engaging in a window of one of said pairs and a tongue having a corrugation resiliently inserted in the other window of the respective pair.

* * * * *